US006669404B2

(12) United States Patent
Le Blanc

(10) Patent No.: US 6,669,404 B2
(45) Date of Patent: Dec. 30, 2003

(54) FOUNDATION DRAIN SYSTEM

(76) Inventor: Donald F. Le Blanc, P.O. Box 73, Linden, MI (US) 48451

( * ) Notice: Subject to any disclaimer, the term of this patent is extended or adjusted under 35 U.S.C. 154(b) by 3 days.

(21) Appl. No.: 09/878,449

(22) Filed: Jun. 11, 2001

(65) Prior Publication Data

US 2002/0187005 A1 Dec. 12, 2002

(51) Int. Cl.[7] ..... E02B 11/00; E04F 17/00
(52) U.S. Cl. ..... 405/36; 52/169.5
(58) Field of Search ..... 405/36, 39, 40, 405/43, 44, 45, 47, 48, 51, 50, 229; 52/302.1, 169.5; 249/34, 39, 2–9

(56) References Cited

U.S. PATENT DOCUMENTS 3,850,193 A * 11/1974 Guzzo ..... 52/169.5 X
4,075,800 A * 2/1978 Molick ..... 52/169.5
4,898,494 A * 2/1990 Ellis ..... 405/50 X
5,158,399 A * 10/1992 Flores ..... 405/50 X
5,634,311 A * 6/1997 Carlton ..... 52/577

* cited by examiner

*Primary Examiner*—Heather Shackelford
*Assistant Examiner*—Sunil Singh
(74) *Attorney, Agent, or Firm*—James C. McLaughlin

(57) ABSTRACT

A low cost, low skill method, and system produced by the method, of providing fluid drainage for a cast concrete footing, including placing a drainage mat against and along the inside of the outside-form-wall; attaching one end of a through-conduit in fluid communication with the drainage mat and extending the other end flush with the inside of the inside-form-wall; placing concrete between the forms; allowing concrete reasonably to cure; removing the forms; attaching conventional drainage to the exposed end of the through-conduit; and backfilling the foundation.

12 Claims, 4 Drawing Sheets

FOUNDATION DRAIN SYSTEM

TECHNICAL FIELD

The present invention deals with static underground structures that drain fluid or gas that is present at the exterior of a foundation or footing. More particularly, the field of the present invention involves the use of a porous medium that is either adjacent to the outside of a foundation or footing or part of a foundation or footing.

DEFINITIONS

The terms foundation and footing are used interchangeably herein to indicate a conventional structure (usually entirely underground) intended to be used to support vertical loads including floors and walls. Footings are customarily relatively wide, so as to maintain reasonable pressures on the underlining ground.

The term mat (or drainage mat) is used herein as equivalent to an alternate type of subsoil drain pipe (conduit) that is formed of a biodegradable resistant plastic back with a dimpled core that is faced with a biodegradable resistant filter fabric that is porous to water, but not soil particles. Such conduits are made by manufactures including JDR Enterprises; Alpharetta, Ga. under trade names that include "J-DRain" and by American Wick Drain Corporation; Monroe, N.C. under trade names that include "AKWAD-RAIN." It is conventional to refer to the filter fabric as a geotextile and to form the filter fabric by techniques that include perforation of a film of biodegradable resistant plastic. It is known to make the filter fabric from plastics that include polypropylene, and to make the back and core from plastics that include polystyrene and polyvinyl chloride. U.S. Pat. Nos. 4,572,700, 4,923,331, and 4,943,185 include descriptions of conduits of the type encompassed by the term mat as used herein, and those patents are incorporated herein by reference. It is known to wrap filter fabric all of the way around the mat.

BACKGROUND

The Problems to be Solved

The major problem to be solved is the reduction of, or the elimination of, the detrimental effects of ground water in the vicinity of footings. Solutions to this major problem lower the water level in the vicinity of the footings.

In most locations, underground structures, such as footings, are subject to hydrostatic pressure from ground water. (Surface water will cause pressures when flooding is present.) A high water level outside of a footing causes an unbalanced pressure acting sideways against the footing. If the water level gets high enough, an unbalanced pressure acting sideways can be exerted on the wall supported by the footing. Footings and supported walls are not usually designed for such pressures, and eventually water will seep into the building through the almost inevitable cracks or joints. While coatings on the outside can reduce the water intrusion, it is usually not economical in residential buildings to design the footings and walls safely to withstand hydrostatically produced side pressures.

The traditional way to relieve hydrostatic pressure is to install a drain around, and close to, the footing. Various materials capable of communicating water are used to form the drains including perforated drain pipe (tile) under and adjacent to a layer of aggregate (such as small stones) that serves to reduce the rate of infiltration of the finer soil, which tends to clog the pipe's perforations.

The traditional practice is to cast the footing with concrete placed between form walls. A trench or hole wider than the eventual footing is dug around the perimeter of the site. Within the trench a form is constructed of an opposing pair of flat, abutting, vertical panels, or boards, made of wood, plastic, metal, or the like, so as to form a continuous channel to receive concrete. The opposing panels are spaced apart (usually by a constant distance) with their flat insides facing the channel and their outsides braced with stakes or the like. To communicate water from outside of the eventual footing to a sump, or the like, that is inside of the footings, sections of four inch pipe are placed on the bottom inside of the form, from one side of the form to the opposite side of the form, about every 25 feet (or as required by code). These periodically placed sections of pipe need to be protected from the ingress of concrete while the concrete is soft and will serve as through-conduits when the forms are removed. Concrete slurry is poured within the channel, leveled, and allowed to cure. After the concrete has cured, the forms are removed, drain pipe and aggregate (as aforementioned) are placed just outside of the footing, connection of the drain pipe to a sump (or the like) is effected (often through the aforementioned through-conduits), and the trench is backfilled. Placing drain pipe and aggregate often must be preceded by a labor intensive clearing of accumulated debris from the trench and the providing of an appropriate bed for the drain pipe. The traditional practice has evolved to include placing a fabric sock around the perforated drain pipe. The sock serves as a sieve to attenuate the ingress of soil particles into the perforated drain pipe while readily passing water. The traditional method just described may fairly be described as conventional.

Effecting a sound, long-lasting system of drainage using the described, conventional system requires significant workmanship. Opportunities for drain pipe to become dislodged or crushed are inherent in the traditional method described. The objectives of the present invention include overcoming the problems of the traditional method and its resultant system. As will be seen, the present invention may be carried out with workmen of little skill, and the system is inherently robust and resistant to damage.

In recent years, another method to relieve part of the hydrostatic pressure has found some favor. Herein, this method is called the horseshoe method. The horseshoe method begins after a foundation (including a set of through-conduits) and the wall the foundation supports have been constructed. Using an adhesive, or some other form of attachment, a mat is attached near the junction of the footing and the wall the footing supports after the wall and footing have been formed. The mat so placed must be periodically connected to a conduit or pipe extending away from the footing. That pipe (called a horseshoe conduit because of its appearance) connects to the mat and then curves down to connect to one of the aforementioned through-conduits. A horseshoe conduit is easily damaged during backfilling and operations near a horseshoe conduit. A horseshoe conduit is associated with each through-conduit and each horseshoe conduit must be water tight.

In addition to the susceptibility of damage to the horseshoe conduits during construction, the technique of using a mat near the junction of the footing and the wall the footing supports has additional issues. Since ground water is only removed from near the top of the footing, hydrostatic pressure on the footing (and on each horseshoe conduit) has not been significantly reduced. Damage to the footing could result and any breach of a horseshoe conduit (which are under pressure) will include damaging ingress of soil into the drainage system.

Whether the traditional method or the horseshoe method is used to effect a drainage system, such drains' through-conduits are connected to a sump, or the equivalent, so that gravity, or a pump, tends to take water away from the footing. The present invention includes a novel way to solve the stated major problem of the reduction of, or the elimination of, the detrimental effects of ground water in the vicinity of footings.

The Efforts of Others

Improvements to the old traditional technique of foundation drainage described previously have long been sought. U.S. Pat. No. 3,613,323 to Hreha shows an early use of a perforated conduit (duct) placed on the outside of, and part of, a footing's form. A similar incorporation of a perforated conduit into the outside of a foundation's form is found in U.S. Pat. No. 5,120,162 to Parker, U.S. Pat. No. 5,399,050 to Jacobus, and U.S. Pat. No. 5,406,785 to Baum. In addition to the presence of a perforated conduit attached to, and on the outside of, a form wall, these devices include an expectation of at least the outside form wall and its conduit being permanent. Advantageously, at least one of the form walls does not have to be removed after concrete sets. Disadvantageously, while there might be a labor savings from not having to remove the permanent form wall, the permanent form wall is expected to be rather complex and expensive to manufacture, and to involve additional labor and expense to erect as compared to the old technique. The resulting drainage conduit will be in front of the resulting foundation and thus subject to all of the hazards attendant to the drainage tile of the older systems of drainage. A net advantage to these systems is not apparent and these systems have not found much favor in the marketplace.

A need remains for a foundation drainage system that minimizes the total capital and labor cost attendant to the total implementation of the drainage system, while producing a system that is inherently long lasting and likely not to be damaged by the hazards attendant to construction. The objectives of the present invention include satisfying these, and other, needs.

SUMMARY OF THE INVENTION

The present invention is a novel process of using mostly existing materials to effect an efficient and relatively inexpensive footing drainage system, and the apparatus that results from the use of that process. The process starts after the form for a footing is erected.

A mat (as previously described) is placed vertically inside of the empty form and with the mat's porous side against the inside of the outside wall of the form. The mat is extended horizontally along the entire length of the inside of the form being periodically spliced with suitable tape, or an equivalent. The bottom edge of the mat rests on the bottom of the form. Should drainage wish to be effected on the inside of a footing, a similar band of mat may be placed against the inside of the inside wall of the form.

Periodically, a T makes a fluid connection between the mat and a through-conduit that extends across the form to an attachment on the opposite form wall. When the form is removed after concrete is poured and cured, the T and through-conduit effect the way for water in the mat to pass to a sump, or the like, that is within the foundation.

Concrete is poured between the form walls and the concrete is leveled. With a small amount of care, it is easy to ensure that while pouring the concrete the concrete presses the mat against a form wall and that no concrete is between the mat and a form wall. The concrete level (height) is expected to be above (taller than) the mat and thus when the concrete cures a protective eyebrow of concrete will be formed above the mat. The presence of an eyebrow of concrete impedes causing damage to the mat after the forms are removed. A person working within the trench after the form is removed cannot step on the mat. The mat is also protected from backfilling of the trench, which takes place after the forms have been removed.

When the concrete has cured, the forms are removed. A conventional drainage system is connected to the now exposed openings to through-conduits (openings appear on the inside of the footing), and, when the trench adjacent to the now exposed fabric side of the mat (the fabric side of the mat appears on the outside of the footing and is essentially flush with the outside face of the footing) is cleared, one may place aggregate fill adjacent to the fabric. However, it has been found that the present invention functions satisfactorily, and preferably, without aggregate fill adjacent to the mat. The remainder of the trench is then backfilled and work progresses to the construction of structures to be supported by the well-drained footing.

DETAILED DESCRIPTION OF THE INVENTION

The present invention includes a method to make an improved foundation drainage system and the improved drainage system itself. While the preferred embodiment of the present invention involves water drainage away from a foundation or footing, it will be apparent that the present invention is applicable to any structure that is cast with concrete, or the like, where at least one form wall is used and where it is desirable to drain away water present adjacent to the structure.

The kernel of the method of the present invention involves the placement, within forms for receiving concrete, of a relatively long material (mat) that is capable of importing water through the material's sides while communicating water longitudinally. The present invention advantageously uses a mat manufactured by several companies that is equivalent to mats previously described. Because of familiarity with the soil drain mat made by American Wick Drain Corporation; Monroe, N.C., that company's AKWAD-RAIN™ prefabricated soil strip drain material is the preferred mat to be used with the present invention. It is apparent that the present invention includes, and can be used with, other materials having the properties that include being able to receive water through the material's sides, capable of communicating water longitudinally, and capable of being placed adjacent to a footing form wall prior to the pouring of concrete into the form. Water is the more important fluid to be appropriately dealt with by the present invention. However, it is apparent that the communication of other fluids is inherent as is the communication of gases including radon.

Figure 1:
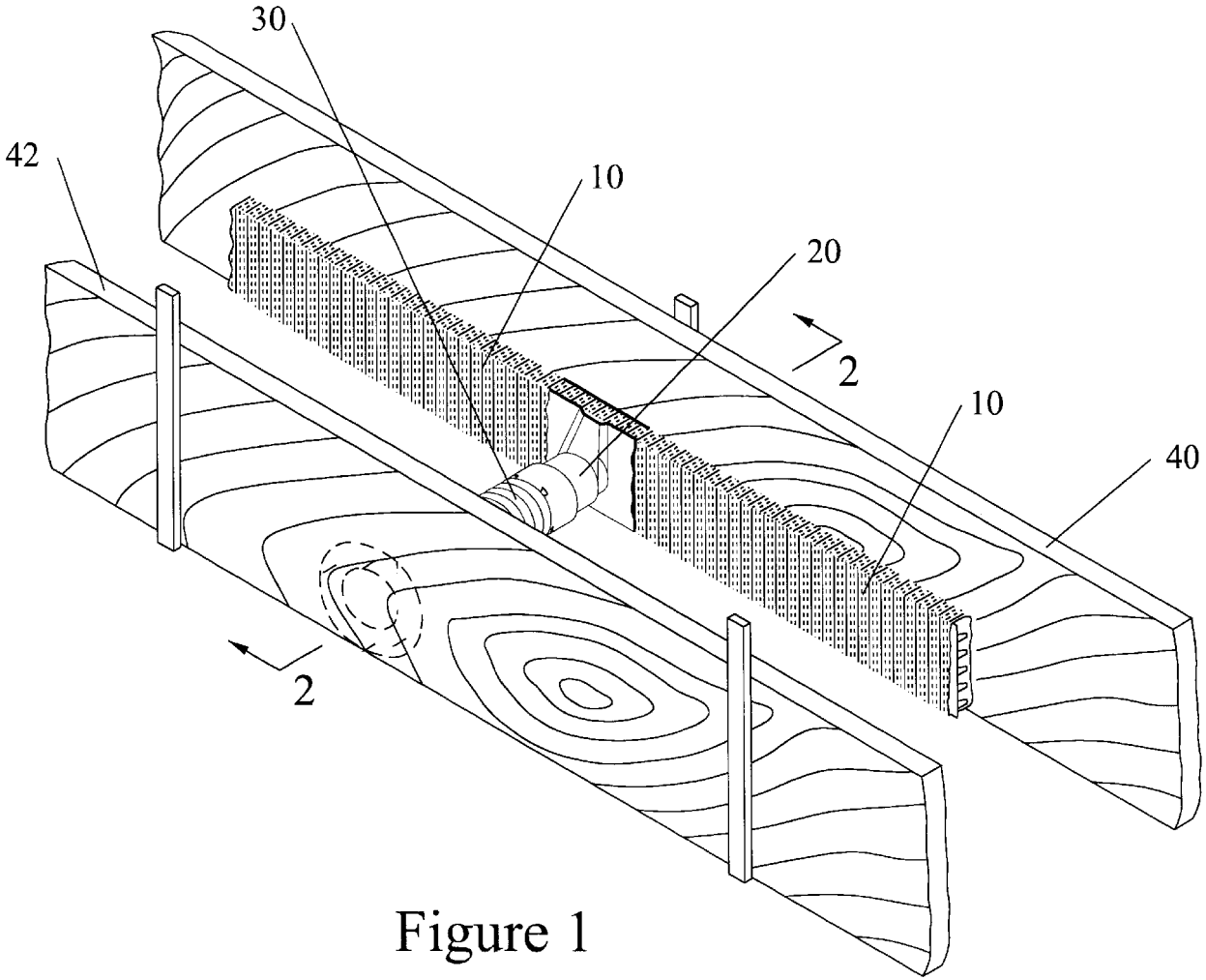
FIG. 1: Perspective view of the inside and outside of a footing form, prior to the pouring of concrete, showing the invention in place.
Figure 2:
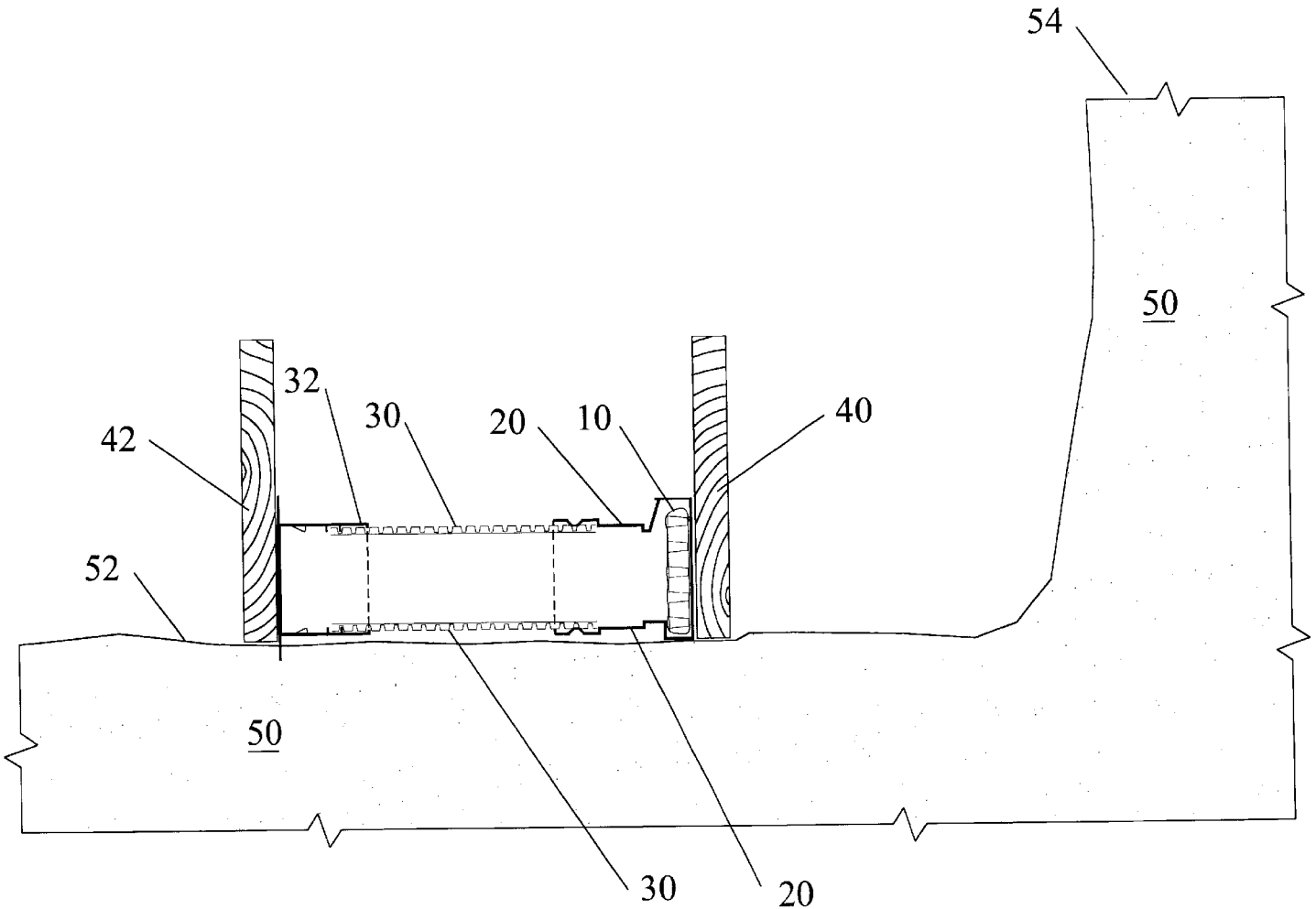
FIG. 2: Cross section through the form shown on FIG. 1 showing a side view of the invention.
Figure 3:
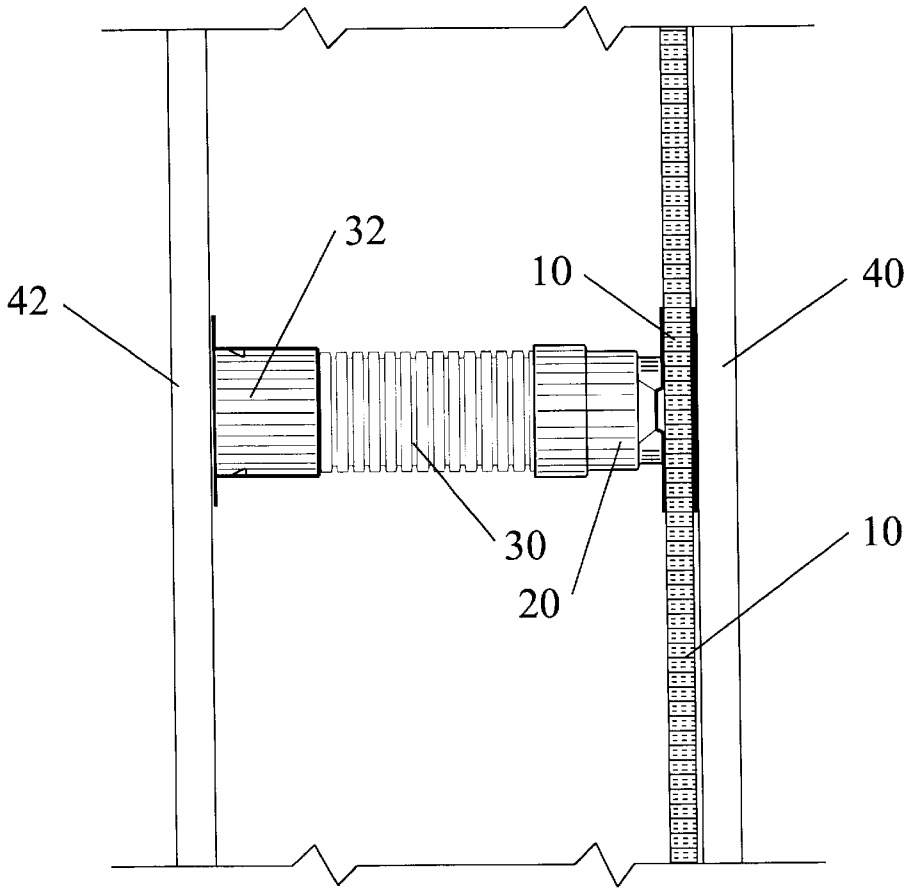
FIG. 3: Top view of the footing form prior to pouring of concrete.

The preferred embodiment of the present invention may be seen even without words on FIGS. 1 through 4. On FIG. 1 one sees that mat 10 is placed along the bottom of the inside of outside-form-wall 40 with the porous face of mat 10 facing outward. Periodically, a T 20 is placed in fluid communication with mat 10 so as to be able to receive whatever fluid is within mat 10. T 20 is attached to through-conduit 30 that extends across the form to flange 32. Flange 32 is attached around its perimeter to the inside of inside-form-wall 42 with nails, or the like, so that concrete is not able to enter through-conduit 30. Thus, an assembly is formed by mat 10, T 20, through-conduit 30, and flange 32. FIG. 2 shows a cross section through the assembly. The top view of FIG. 3 makes clear that mat 10 extends the entire length of the footing form.

To effect communication of water collected by mat 10 to a sump, or the like, aforementioned assemblies are spaced about 25 feet apart (or as required by applicable codes) along the form. The figures show only one such assembly.

Preferably, mat 10 is an AKWADRAIN™ soil strip drain made by American Wick Drain Corporation with a nominal thickness of one inch and a nominal height of six inches. The preferred mat 10 is available in one hundred foot lengths and thus only a few splices between lengths are needed on a residential foundation. Preferably those splices, not shown on the figures, are made by butting the ends of the mat 10 together and then wrapping with an appropriate tape having a contrasting color (such as white) so that the splices may easily be seen when looking down into the resulting footing from the ground surface.

Preferably, T 20 is adapted from a T manufactured by American Wick Drain Corporation and originally intended to be connected to a mat so as to extend away from the fabric side of the mat. Similar Ts suitable for use with the present invention are made by others and such Ts are readably fabricated.

Preferably, through-conduit 30 and its flange 32 are adapted from a conduit made by Carlton Industries of Flint, Mich. U.S. Pat. No. 5,643,311, incorporated herein by reference, shows the preferred conduit prior to adaptation on FIGS. 3 and 4. The adaptation includes replacing a flange on one end of the conduit of the '311 patent with T 20. The present invention is not limited to the use of only the preferred through-conduit.

After mat 10 has been placed within the footing form and connected to sets of T 20 and through-conduit 30 in the manner described, concrete is poured between outside-form-wall 40 and inside-form-wall 42. Flange 32 anchors one end of through-conduit 30. The stiffness of through-conduit 30, and gravity, serve to keep the assembly in place. Only slight care needs to be exercised while pouring concrete to ensure that the concrete exerts pressure against the back of mat 10 so as to press the fabric face of mat 10 against the inside of outside-form-wall 40 without allowing any concrete to appear between the fabric face of mat 10 and the inside of outside-form-wall 40. The depth of concrete is expected to be greater than the height of mat 10 so that concrete will be above all of the assembly.

Figure 4:
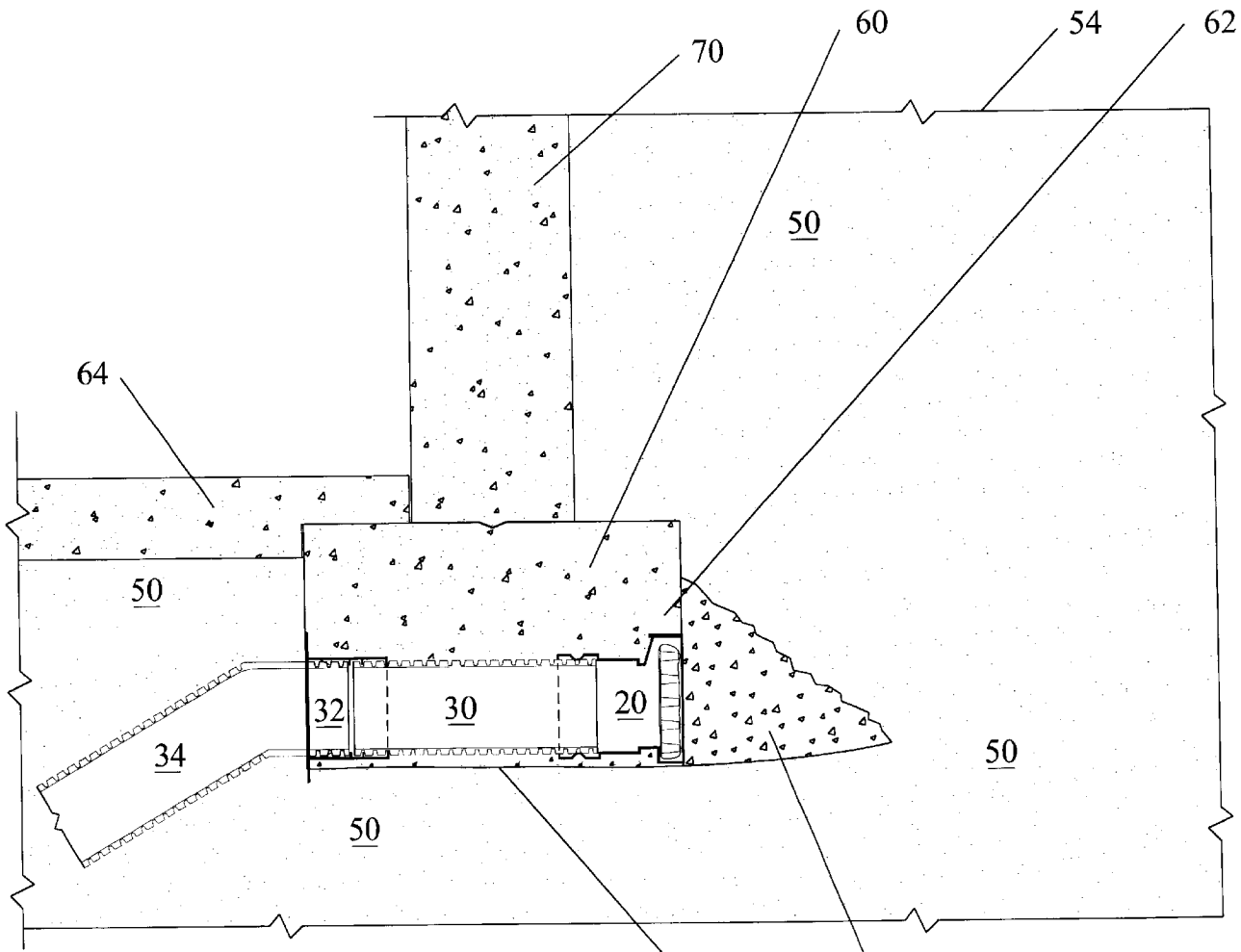
FIG. 4: Cross section in the same location as the cross section of FIG. 2 after the footing, and the wall and floor the footing supports, is finished.

After concrete is poured between outside-form-wall 40 and inside-form-wall 42 to an appropriate depth that is greater than the height of mat 10, the concrete is allowed to cure. When the concrete is reasonably cured, the form is removed. Outside-form-wall 40 and inside-form-wall 42 are removed leaving a concrete footing with mat 10 at its outside base prepared to receive water present on the outside of the footing and to communicate the water so received through the footing using a set of Ts 20 and associated through-conduits 30 to the inside of the footing. Inside of the footing, an inside drain 34 is attached to the now open through-conduit 30. Inside drain 34 communicates in a conventional manner to a sump, or the like. Optionally, as shown on FIG. 4, aggregate 56 is placed against mat 10 so as to facilitate filtering, and the outside of the footing trench is backfilled with fill 50. It has been found that the practice of this invention does not require aggregate 56 being placed against mat 10 prior to backfilling, and that lack of a need to use aggregate 56 is a feature of the present invention. The preferred way of practicing the present invention is not to use aggregate. One may now proceed to use the footing to receive floor 64 or wall 70. FIG. 4 shows a cross section through a finished concrete footing 60. Note the protective eyebrow 62 of concrete that is above mat 10. Eyebrow 62 is desirable. However, it is known to have mat 10 cover all of the face of the footing rather than the preferred recessing of mat 10 into part of the face of the footing.

The present invention includes a method of providing fluid drainage for a concrete footing 60 that is cast by placing concrete between an outside-form-wall 40 and an inside-form-wall 42, including, after the form walls are erected, the steps of: placing a drainage mat 10, having a face and a back, against the inside of the outside-form-wall 40 extending along the length of the outside-form-wall 40; attaching the proximate end of at least one through-conduit (such as through-conduit 30) in fluid communication with the drainage mat 10 and extending the distal end of the through-conduit to be flush with the inside of the inside-form-wall 42; placing concrete between the outside-form-wall 40 and the inside-form-wall 42; allowing concrete reasonably to cure, which produces a foundation 60; removing the outside-form-wall 40 and the inside-form-wall 42; attaching conventional means for drainage (such as inside drain 34) to the exposed distal end of at least one through-conduit; and backfilling the foundation.

The foundation drainage system produced by the method of the present invention includes a drainage mat 10 essentially flush with the outside of the foundation, and at least one through-conduit (such as through-conduit 30) in fluid communication with drainage mat 10 and extending through the concrete footing 60 to communicate with conventional means for drainage (such as inside drain 34).

The foundation drainage system produced by the method of the present invention may also be described with reference to the essentially flat surface of the outward-looking face of concrete footing 60 even when the essentially flat surface of the outward-looking face of concrete footing 60 is not vertical. In such a case, the drainage mat 10 may be described as being recessed into part of the outward-looking-face of the foundation 60 such that the mat's outward-looking-face does not extend significantly outward of the essentially flat surface of the outward-looking-face of the foundation, and such that at least one through-conduit (such as through-conduit 30) is in fluid communication with drainage mat 10 and extending through the foundation 60 to communicate with conventional means for drainage (such as inside drain 34).

Preferably the method and system include: the use of a drainage mat that is capable of importing fluid through the mat's face while communicating fluid longitudinally or a drainage mat that has a biodegradable resistant back with dimpled core and a face of biodegradable resistant filter fabric that is porous to water, but not soil particles; and placing concrete to a height greater than that of the drainage mat so as to produce eyebrow 62.

Preferably the system includes the drainage mat 10 being surmounted with part of the foundation's concrete, and the drainage mat 10 being recessed into part of the outward-looking-face of the foundation between the bottom of the foundation 52 and the top of the foundation.

It will be apparent to one skilled in the art that variations of the disclosed invention are possible without departing from the essence of the invention. Alternates to the preferred mat 10 are ubiquitous. Alternate ways to implement the function of the preferred T 20 and through-conduit 30 may be developed with little experimentation. Such modifications and equivalents are within the ambit of the present invention.

I claim:

1. A method of providing fluid drainage for a foundation that is cast by placing concrete between an outside-form-wall and an inside-form-wall, comprising, after the form walls are erected, the steps of:

placing a drainage mat, having a face and a back, against the inside of the outside-form-wall extending along the length of the outside-form-wall;

attaching the proximate end of at least one through-conduit in fluid communication with said drainage mat and extending the distal end of said through-conduit to be flush with the inside of the inside-form-wall;

placing concrete between the outside-form-wall and the inside-form-wall;

allowing said concrete reasonably to cure, whereby the foundation results;

removing the outside-form-wall and the inside-form-wall;

attaching conventional means for drainage to the exposed distal end of said at least one through-conduit; and backfilling the foundation.

2. The method of claim 1 wherein said drainage mat is capable of importing fluid through said mat's face while communicating said fluid longitudinally.

3. The method of claim 1 wherein said back of said drainage mat is biodegradable resistant with dimpled core and said face of said drainage mat is of biodegradable resistant filter fabric that is porous to water, but not soil particles.

4. The method of claim 1 wherein said step of placing concrete between the outside-form-wall and the inside-form-wall further includes placing concrete to a height greater than that of said drainage mat.

5. A drainage system for providing fluid drainage for a foundation that is cast by placing concrete between an outside-form-wall and an inside-form-wall, comprising:

a drainage mat essentially flush with the outside of the foundation;

at least one through-conduit in fluid communication with said drainage mat and extending through the foundation to communicate with conventional means for drainage; and wherein said drainage mat has a biodegradable resistant back with dimpled core and a face of biodegradable resistant filter fabric that is porous to water, but not soil particles.

6. The system of claim 5 wherein said drainage mat is surmounted with part of the foundation's concrete.

7. A drainage system for providing fluid drainage for a concrete foundation that has a top, a bottom, and an outward-looking-face having an essentially flat surface, comprising:

a drainage mat, having an outward-looking-face, recessed into part of the outward-looking-face of the foundation such that said mat's outward-looking-face does not extend significantly outward of the essentially flat surface of the outward-looking-face of the foundation;

at least one through-conduit in fluid communication with said drainage mat and extending through the foundation to communicate with conventional means for drainage;

wherein said drainage mat further has a back and a top; and wherein said mat's outward-looking-face is porous only to fluid.

8. The system of claim 7 wherein said drainage mat is capable of importing fluid through said mat's outward-looking-face while communicating said fluid longitudinally.

9. The system of claim 7 wherein said drainage mat's back is biodegradable resistant with a dimpled core, and said mat's outward-looking-face is biodegradable resistant filter fabric that is porous to water, but not soil particles.

10. The system of claim 7 wherein said drainage mat's top is below the concrete foundation's top.

11. A method of providing fluid drainage for a foundation that is cast by placing concrete between an outside-form-wall and an inside-form-wall, comprising, after the form walls are erected, the steps of:

placing a drainage mat, having a face and a back, against the inside of the outside-form-wall extending along the length of the outside-form-wall;

attaching the proximate end of at least one through-conduit in fluid communication with said drainage mat and extending the distal end of said through-conduit to be flush with the inside of the inside-form-wall;

placing concrete between the outside-form-wall and the inside-form-wall;

allowing said concrete reasonably to cure, whereby the foundation results;

removing the outside-form-wall and the inside-form-wall;

attaching conventional means for drainage to the exposed distal end of said at least one through-conduit;

placing aggregate next to said drainage mat; and backfilling the foundation.

12. A drainage system for providing fluid drainage for a foundation that is cast by placing concrete between an outside-form-wall and an inside-form-wall, comprising:

a drainage mat essentially flush with the outside of the foundation;

at least one through-conduit in fluid communication with said drainage mat and extending through the foundation to communicate with conventional means for drainage;

wherein said drainage mat has a face and is capable of importing fluid through said mat's face while communicating said fluid longitudinally; and wherein said drainage mat is surmounted with part of the foundation's concrete.

* * * * *